US008732920B2

(12) United States Patent
Leconte et al.

(10) Patent No.: US 8,732,920 B2
(45) Date of Patent: May 27, 2014

(54) TOOLING AND A METHOD FOR HOT FORGING PIECES OF SHEET METAL

(75) Inventors: Gilbert Michel Marin Leconte, Ozoir la Ferriere (FR); Jean-Michel Patrick Maurice Franchet, Paris (FR); Gilles Charles Casimir Klein, Mery sur Oise (FR); Dominique Magnaudeix, Yerres (FR)

(73) Assignee: SNECMA, Paris (FR)

( * ) Notice: Subject to any disclaimer, the term of this patent is extended or adjusted under 35 U.S.C. 154(b) by 87 days.

(21) Appl. No.: 13/347,108

(22) Filed: Jan. 10, 2012

(65) Prior Publication Data

US 2012/0174384 A1 Jul. 12, 2012

(30) Foreign Application Priority Data

Jan. 10, 2011 (FR) ..... 11 50169

(51) Int. Cl.
*B21K 3/04* (2006.01)

(52) U.S. Cl.
USPC ..... 29/23.51; 29/889.7; 72/475

(58) Field of Classification Search
USPC ..... 29/23.51, 889, 889.2, 889.6, 889.7, 29/889.71, 889.72, 464, 465, 466, 281.1; 72/470, 474, 475
See application file for complete search history.

(56) References Cited

U.S. PATENT DOCUMENTS

| | | | | |
|---|---|---|---|---|
| 2,958,362 | A * | 11/1960 | Creek | 72/412 |
| 5,469,618 | A | 11/1995 | LeMonds et al. | |
| 6,210,630 | B1 * | 4/2001 | Bergue et al. | 266/96 |

FOREIGN PATENT DOCUMENTS

| | | | |
|---|---|---|---|
| EP | 0 812 649 | A1 | 12/1997 |
| EP | 1 574 270 | A1 | 9/2005 |
| EP | 2 295 164 | A2 | 3/2011 |
| GB | 721478 | | 1/1955 |
| WO | WO 94/23890 | | 10/1994 |
| WO | WO 2010/084942 | A1 | 7/2010 |

OTHER PUBLICATIONS

French Preliminary Search Report issued Aug. 31, 2011, in Patent Application No. FR 1150169 (with English Translation of Category of Cited Documents).

* cited by examiner

*Primary Examiner* — David Bryant
*Assistant Examiner* — Ryan J Walters
(74) *Attorney, Agent, or Firm* — Oblon, Spivak, McClelland, Maier & Neustadt, L.L.P.

(57) ABSTRACT

The invention provides tooling and a method for hot forging pieces of sheet metal that are to form metal reinforcement mounted on the leading or trailing edge of a turbine engine blade, by means of bottom and top matrices each presenting a twisted elongate surface for use in shaping an initially plane piece of sheet metal, the shaping surface of the bottom matrix presenting a high portion, a low portion, and two end zones. The bottom matrix includes studs for positioning and guiding the piece, the studs being situated at the periphery of the corresponding shaping surface.

5 Claims, 4 Drawing Sheets

TOOLING AND A METHOD FOR HOT FORGING PIECES OF SHEET METAL

FIELD OF THE INVENTION

The present invention relates to tooling and to a method for hot forging pieces of sheet metal that are to form metal reinforcement for mounting on the leading or trailing edge of a blade of a turbine engine, such as an airplane turboprop or turbojet.

BACKGROUND OF THE INVENTION

In order to reduce the weight and the cost of the blades of turbine engine fans, they are generally made out of composite material. Fan blades need to be capable of withstanding high levels of shock and impact because of their speed of rotation and because of collisions with particles or foreign bodies that may penetrate into the stream of air. For this purpose, composite blades are protected at their leading and/or trailing edges by metal reinforcement that is adhesively bonded to the airfoils of the blades.

Document EP 1 547 270-A1, in the name of the applicant, describes a method of fabricating such reinforcement by superplastic forming and diffusion bonding (SPF/DB), which method consists in:

- bonding two pieces of sheet metal together by diffusion bonding in order to obtain a preform, some portions of the pieces being covered in an anti-diffusion substance in order to prevent them bonding together in determined zones;
- curving and twisting the preform;
- inflating the preform so that it is subjected to superplastic forming; and
- cutting the preform in order to obtain the reinforcement.

That method does not make it possible to control the inside shape of the cavity in the reinforcement with accuracy. In particular, the junction zones between the pieces of sheet metal form stress concentration zones where break starters weaken the reinforcement.

In order to improve the mechanical strength of the reinforcement, patent application FR 10/51992, filed by the applicant and not yet published, proposes a method of making metal reinforcement, which method consists in:

- shaping two pieces of sheet metal in order to bring them close to the final shape of the reinforcement that is to be made;
- positioning the two pieces of sheet metal on either side of a core reproducing the inside shapes of the suction side and of the pressure side of the reinforcement;
- assembling the two pieces of sheet metal together around the core in leaktight manner under a vacuum;
- shaping the pieces of sheet metal on the core by hot isostatic compression; and
- cutting the pieces of sheet metal in order to separate the reinforcement and release the core.

Hot isostatic compression enables the pieces of sheet metal to be shaped to have the same shape as the core, thus making it possible in the junction zone between the pieces of sheet metal to obtain a large radius of connection and consequently to avoid any zone of stress concentration or of break starters.

Prior to being positioned around the core, the shaping of the pieces of sheet metal is performed in a plurality of successive hot-forming operations.

Nevertheless, it is difficult to control accurately the shape, the thicknesses, and the surface states of the sheet metal pieces as formed in that way. In addition, the duration and the cost of such operations are relatively high. Finally, the shaped pieces need to be machined after forming, which is particularly difficult and expensive when they present a three-dimensional profile. It is easier to machine sheet metal while it is plane, i.e. before it is shaped.

OBJECT AND SUMMARY OF THE INVENTION

A particular object of the invention is to provide a solution to these problems that is simple, effective, and inexpensive.

To this end, the invention provides tooling for hot forging pieces of sheet metal that are to form metal reinforcement mounted on the leading or trailing edge of a turbine engine blade, the tooling comprising bottom and top matrices, each presenting a twisted elongate surface for use in shaping an initially plane piece of sheet metal, the shaping surface of the bottom matrix presenting a high portion, a low portion, and two end zones, wherein the bottom matrix includes at least three studs for positioning and guiding the piece, the studs being situated at the periphery of the corresponding shaping surface, the first and second studs being positioned respectively at each of the end zones of the shaping surface, a third stud being situated level with the low portion of the shaping surface.

The studs serve firstly to position the piece accurately, simply, and quickly on the bottom matrix, and secondly to guide the corresponding edge of the piece while it is being deformed, in such a manner as to control its position throughout the shaping step. The positions and the numbers of studs are defined as a function of applications.

The piece is shaped in a single operation and its deformation can be controlled accurately. The reproducibility of the operation makes it possible to determine which machining operations need to be performed beforehand on the initial plane piece of sheet metal, so as to generate the zones of selected thickness.

The final profile of the piece may thus be as close as possible to the profile of the part that is to be obtained, so as to limit any expensive operation of machining a part in three dimensions.

Advantageously, three of the studs are all situated on the same side of a middle longitudinal axis of the shaping surface of the bottom matrix.

Since the lateral forces that are generated during deformation are directed downwards, there is no need for the piece to have an obstacle against which to bear on its side remote from the low portion.

According to a characteristic of the invention, the height of the third stud is not less than the difference in height between the high portion and the low portion of the shaping surface.

In this way, the piece may be guided by the third stud throughout the time it is being deformed.

According to another characteristic of the invention, at least one stud extends perpendicularly to the periphery of the shaping surface and presents a section that tapers towards the inside of the shaping surface, so as to form a point or line bearing zone for the edge of the piece.

Preferably, the bottom matrix includes a fourth stud situated level with the high portion of the shaping surface in a zone of greatest curvature of the corresponding edge of the shaping surface.

The fourth stud makes it possible to hold the piece even more effectively in the matrix by preventing any slip.

The invention also provides a method of fabricating a twisted piece of sheet metal for making metal reinforcement for mounting on the leading or trailing edge of a turbine engine blade, the method comprising the steps consisting in:

cutting a piece out from plane sheet metal of substantially constant thickness, e.g. by water-jet cutting;

machining the plane piece in order to make zones of different thicknesses;

heating the piece;

putting the piece into place in tooling of the above-specified type, the piece bearing via its edges on the shaping surface of the bottom matrix and against the holding and guiding studs;

shaping the piece in a single forging operation by moving the two matrices of the tooling towards each other, the sheet being deformed progressively so as to match the shape of the shaping surfaces of the matrices, the edge of the sheet being guided by the studs while it is being shaped; and removing the piece from the tooling.

Preferably, the piece is made of a titanium-based alloy, e.g. of TA6V, and it is heated to about 940° C. before being put into place in the tooling.

The piece may be cooled before being removed from the tooling.

Advantageously, after the initial cutting-out step, the piece is provided with grip means at one of its ends.

These grip means enable the piece to be removed from the bottom matrix after shaping.

After forging, final machining of the piece may be performed in a chemical bath.

BRIEF DESCRIPTION OF THE DRAWINGS

The invention can be better understood and other details, characteristics, and advantages of the invention appear on reading the following description made by way of non-limiting example and with reference to the accompanying drawings, in which.

MORE DETAILED DESCRIPTION

The method of the invention consists initially in cutting out a piece from plane sheet metal of substantially constant thickness, e.g. by water-jet cutting. The sheet is made of a titanium-based alloy, for example TA6V.

Figure 1:
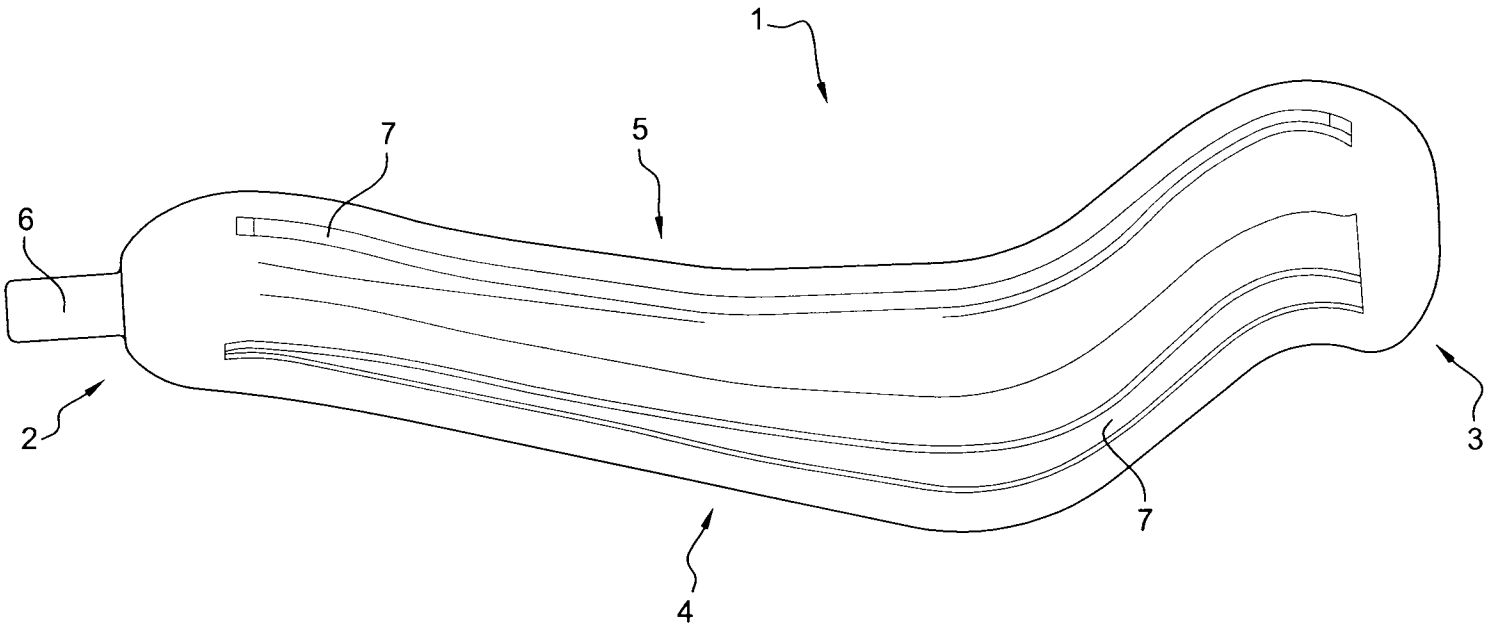
FIG. 1 is a face view of an initially plane cut-out piece of sheet metal, prior to being shaped using tooling of the invention.

The piece 1 obtained after cutting out is shown in FIG. 1. It is of elongate and curved or S-shape, and it presents a periphery formed by two ends 2, 3 and two side edges 4, 5.

The end 2 is provided with a plane grip tongue 6 that extends outwards.

On one and/or the other of its bottom and top faces, the piece 1 may include zones 7 of different thicknesses, which may project or be indented. These curved or S-shaped zones 7 extend substantially in the longitudinal direction of the piece and they are approximately parallel to its side edges.

These zones 7 may be obtained by machining the piece 1 while flat, e.g. by milling it. The plane sheet metal 1 may be machined before or after the cutting-out operation.

Figure 2:
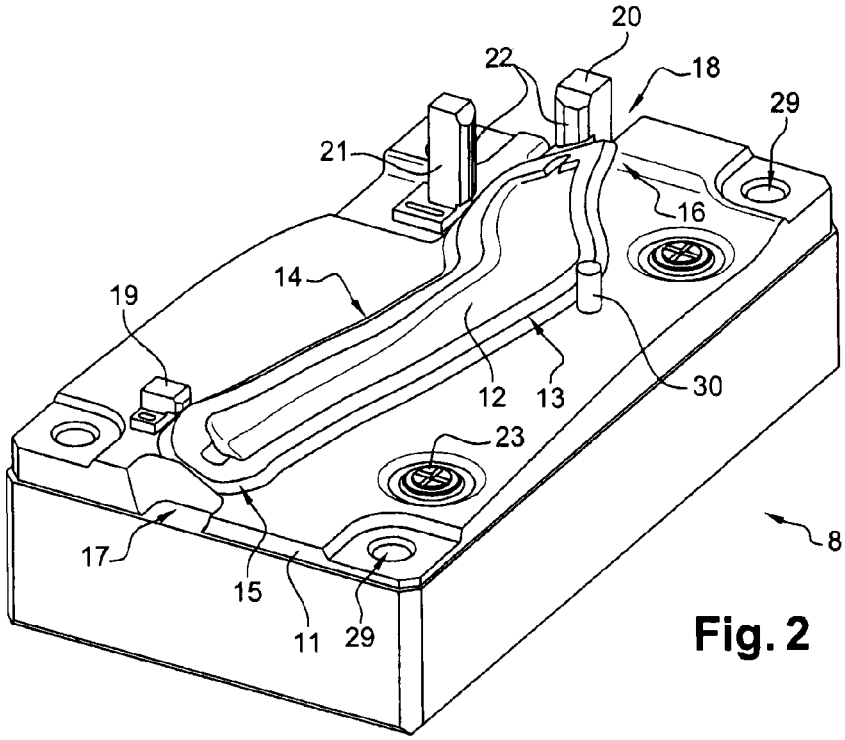
FIG. 2 is a perspective view from above of a bottom matrix of tooling of the invention.
Figure 3:
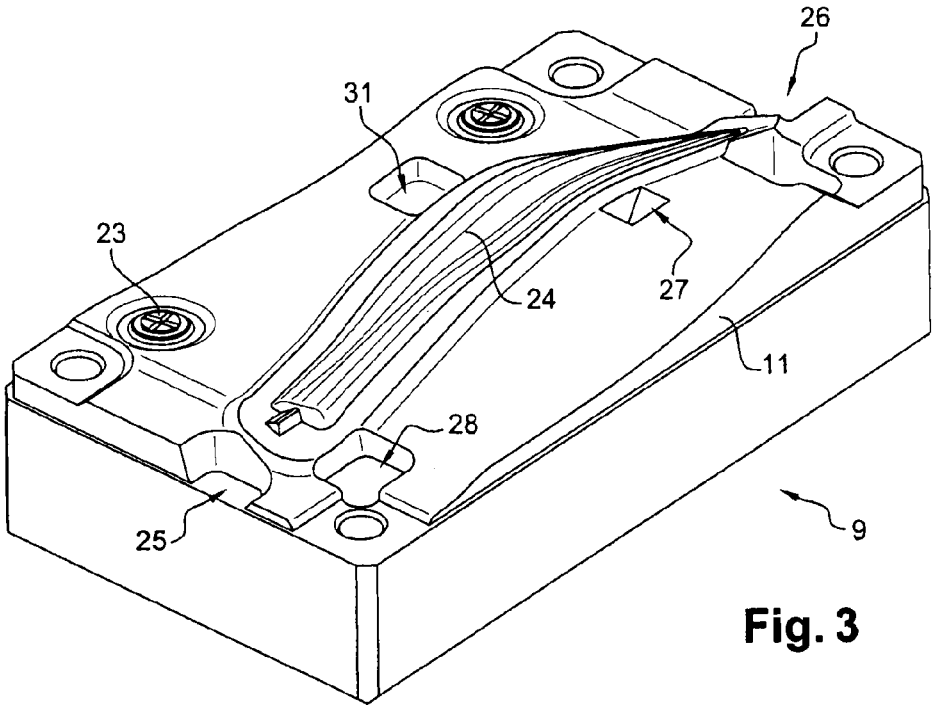
FIG. 3 is a perspective view from below of a top matrix of tooling of the invention.

The piece 1 is then heated to about 940° C. prior to being put into place in tooling that comprises a bottom matrix 8 and a top matrix 9, visible respectively in FIGS. 2 and 3.

The bottom matrix 8 presents a cavity 11 having a twisted shaping surface 12 and presenting a high portion 13, a low portion 14, and two end zones 15 and 16. The cavity 11 is conventionally fitted with crosses 23 serving to ensure that one cavity is properly positioned relative to the other.

Two setbacks 17 and 18 are formed in the cavity 11, at its ends 15 and 16.

Three studs or columns 19, 20, and 21 for positioning and guiding the piece 1 are situated at the periphery of the shaping surface 12, with first and second studs 19 and 20 being positioned respectively in the vicinity of each of the end zones 15 and 16 of the shaping surface 12, and with the third stud 21 being situated in the low portion 14 of the shaping surface 12.

The stud 20 is mounted in the setback 18 and it projects upwards out therefrom.

The studs 19, 20, and 21 are all situated on the same side of a middle longitudinal axis of the shaping surface 12 of the bottom matrix 8, i.e. on the same side as the low portion 14.

The top ends of each of the studs 19, 20, and 21 are all situated in a horizontal plane located above the high portion 13 of the shaping surface 12.

By way of example, the length of the piece 1 may lie in the range 700 millimeters (mm) to 900 mm, its width may lie in the range 200 mm to 300 mm, and its thickness may lie in the range 1 mm to 4 mm, depending on the zone.

Each stud 19, 20, and 21 extends perpendicularly to the periphery of the shaping surface 12 and it presents a section that tapers towards the inside of the shaping surface 12 so as to form a point or line bearing zone for the edge of the piece 1.

In the example shown in the figures, each of the studs 19, 20, and 21 is of generally square section, the surface 22 of each stud that faces towards the shaping surface 12 being rounded or pointed.

A fourth stud 30 of cylindrical shape is situated at the periphery of the shaping surface, the side of the high portion 13. This stud 30 is more particularly situated in a zone of greater curvature of the corresponding edge of the shaping surface 12.

The top matrix 9 also presents a cavity 11 fitted with crosses 23 and having a twisted shaping surface 24 of a shape that is complementary to the shaping surface 12 of the bottom matrix 8. Two setbacks 25 and 26 are provided in the top cavity 9, at the ends of the surface 12. The cavity also has three housings 27, 28, and 31, said housings 27, 28, and 31, together with the setback 26 serving respectively to receive the studs 21, 19, 30, and 20 when the two matrices 8 and 9 are moved towards each other. The bottom and top matrices 8 and 9 also include guide holes 29 for passing guide rods (not shown) enabling the matrices 8 and 9 to be positioned, and also enabling the movable top matrix 9 to be moved relative to the stationary bottom matrix 8.

Figure 4:
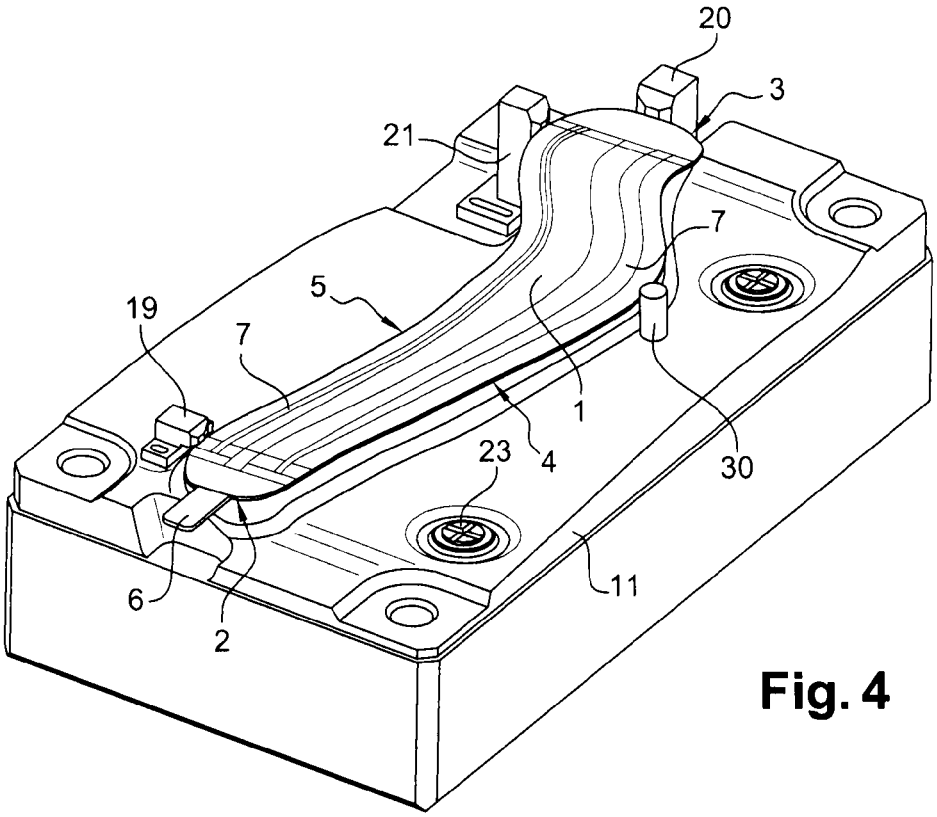
FIG. 4 shows the FIG. 1 plane cut-out piece of sheet metal in position on the bottom matrix, prior to shaping.
Figure 6:
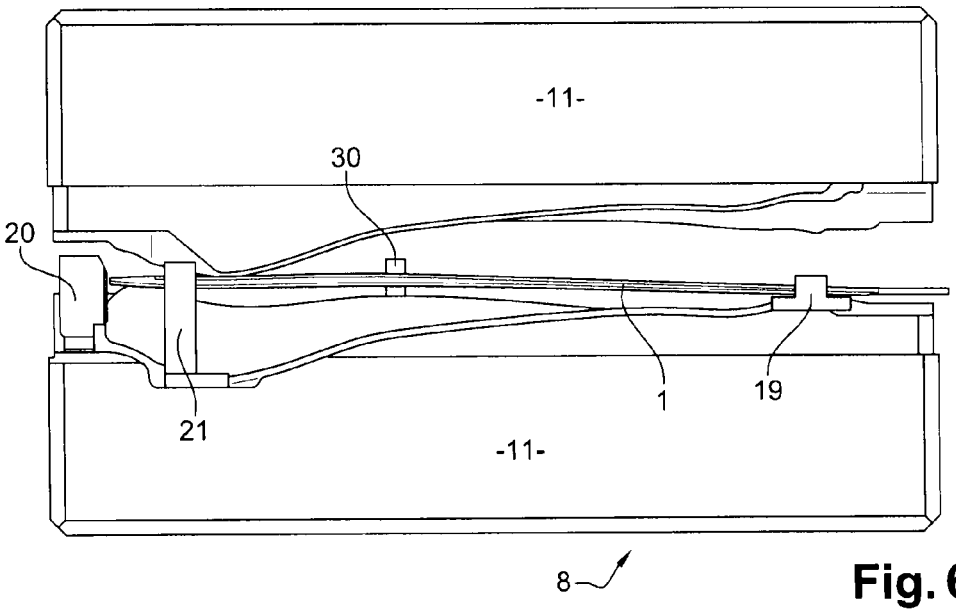
FIG. 6 is a side view of the tooling and of the FIG. 1 piece of sheet metal, prior to shaping.
Figure 7:
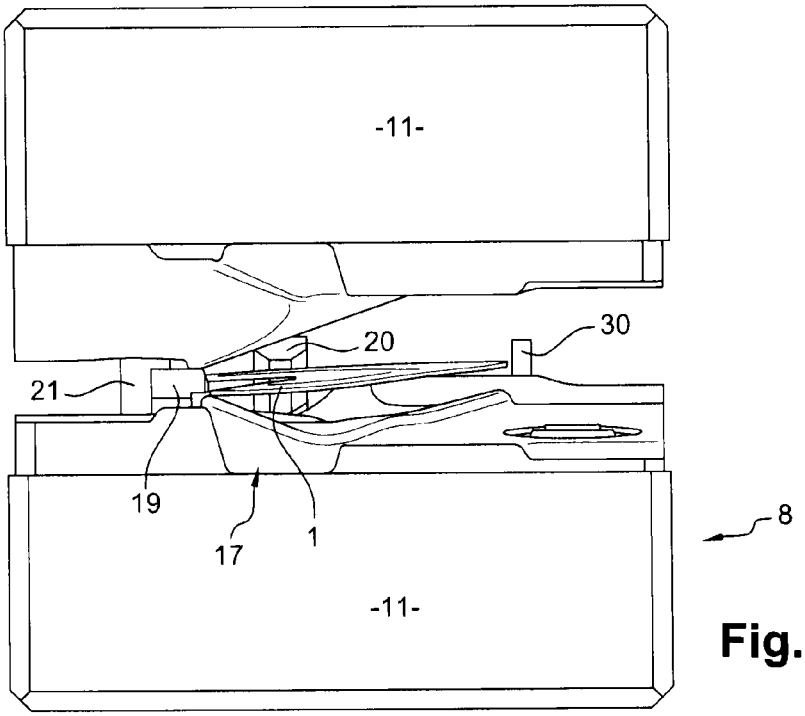
FIG. 7 is an end view of the tooling and of the FIG. 1 piece of sheet metal, prior to shaping.

After being heated, the cut-out and machined piece of sheet metal 1 is mounted between the bottom matrix 8 and the top matrix 9 using the grip tongue 6 (FIGS. 4, 6, and 7). In particular, the piece 1 rests via its peripheral edge on the shaping surface 12 of the lower matrix 8 (via substantially point-sized contact zones), said edge also coming to bear laterally against the side surfaces 22 of the studs 19, 20, 21, and 30 so as to ensure that the piece 1 is accurately positioned relative to the bottom matrix 8.

Figure 5:
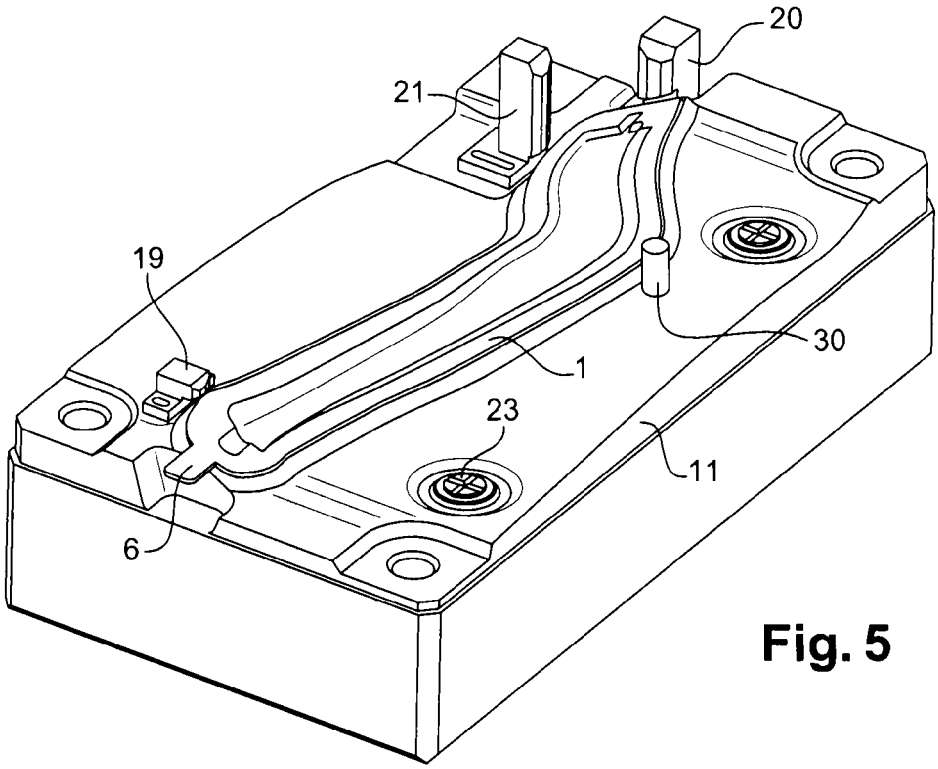
FIG. 5 is a view corresponding to FIG. 4, showing the piece of sheet metal after shaping by using the tooling of the invention.

The piece 1 is then shaped in a single forging or die-stamping operation by moving the two matrices 8 and 9 of the tooling towards each other, the piece 1 being deformed progressively so as to match the shape of the shaping surfaces 12 and 24 of the matrices (FIG. 5). The edge of the piece 1 is guided by the studs 19, 20, 21, and 30 throughout the shaping operation, so as to avoid any undesired movement of the piece while it is being shaped and so as to guarantee that its final shape is as close as possible to the desired shape.

The piece 1 is then cooled in free air prior to being removed from the tooling. Finally, the piece 1 is subjected to a final machining operation in a chemical bath.

The method and the tooling of the invention thus enable pieces of sheet metal to be formed simply, quickly, and accurately. Furthermore, the pieces shaped in this way do not require any mechanical machining after they have been shaped.

The invention claimed is:

1. A tooling for hot forging pieces of sheet metal that form metal reinforcements mounted on leading or trailing edges of turbine engine blades, the tooling comprising:

a bottom matrix including a first shaping surface that is a twisted elongate surface;

a top matrix including a second shaping surface that is a twisted elongate surface;

wherein the bottom matrix and top matrix are for use in shaping an initially plane piece of sheet metal, wherein the first shaping surface includes a high portion, a low portion in a position below the high portion in a vertical direction, and two end zones on opposite sides of the first shaping surface, wherein the bottom matrix includes at least three studs extending above the high portion in the vertical direction for positioning and guiding the initially plane piece of sheet metal, the at least three studs being situated at a periphery of the first shaping surface and including:

a first stud and a second stud positioned at respective end zones of the first shaping surface, and a third stud extending from a position in the vertical direction below the low portion of the first shaping surface and having a length greater than respective lengths of the first stud and the second stud.

2. Tooling according to claim 1, wherein the at least three studs are situated on one side of a middle longitudinal axis of the first shaping surface of the bottom matrix.

3. Tooling according to claim 1, wherein the length of the third stud is not less than a difference between a height of the high portion and a height of the low portion of the first shaping surface.

4. Tooling according to claim 1, wherein at least one stud of the at least three studs extends perpendicularly to the periphery of the first shaping surface and has a section that tapers towards an inside of the first shaping surface and forms a point or line bearing zone for an edge of the initially plane piece of sheet metal.

5. Tooling according to claim 1, wherein the bottom matrix includes a fourth stud situated level with the high portion of the first shaping surface in a zone of greatest curvature of a corresponding edge of first the shaping surface.

* * * * *